US005358629A

United States Patent [19]

Tamalis et al.

[11] Patent Number: 5,358,629

[45] Date of Patent: Oct. 25, 1994

[54] HYDROCONVERSION PROCESS CONTAINING A MOLYBDENUM COMPLEX RECOVERED FROM EPOXIDATION OF OLEFINIC HYDROCARBONS

[75] Inventors: George R. Tamalis; David D. Chess, both of Houston, Tex.; Mahendra S. Patel, Hopewell Junction; Ajit K. Bhattacharya, Beacon, both of N.Y.; Robert M. Gipson, Port Arthur, Tex.

[73] Assignee: Texaco Inc., White Plains, N.Y.

[21] Appl. No.: 6,594

[22] Filed: Jan. 21, 1993

[51] Int. Cl.[5] ..... C10G 47/02; C10G 45/04

[52] U.S. Cl. ..... 208/112; 208/111; 208/216 R; 208/217; 208/251 H

[58] Field of Search ..... 208/112, 111, 123, 124, 208/215, 216 R, 251 H, 254 H, 110

[56] References Cited

U.S. PATENT DOCUMENTS

| | | | |
|---|---|---|---|
| 3,887,455 | 6/1975 | Hamner et al. | 208/112 |
| 4,313,818 | 2/1982 | Aldridge et al. | 208/112 |
| 4,348,270 | 9/1982 | Bearden, Jr. et al. | 208/112 |
| 4,483,762 | 11/1984 | Grosboll | 208/216 R |
| 4,520,128 | 5/1985 | Morales et al. | 208/112 |

*Primary Examiner*—Paul Lieberman
*Assistant Examiner*—Lorna M. Douyon
*Attorney, Agent, or Firm*—Kenneth R. Priem; Carl G. Seutter; Cynthia L. Kendrick

[57] ABSTRACT

A waste molybdenum-containing stream recovered from the work-up of a reaction mixture wherein propylene has reacted with t-butyl hydroperoxide to form propylene oxide (in the presence of a complex of ethylene glycol and a molybdenum compound) is passed as an oil-miscible/soluble molybdenum-containing catalyst to a reaction wherein heavy hydrocarbon is hydroconverted to lower boiling products in the presence of heterogeneous catalyst.

2 Claims, No Drawings

HYDROCONVERSION PROCESS CONTAINING A MOLYBDENUM COMPLEX RECOVERED FROM EPOXIDATION OF OLEFINIC HYDROCARBONS

RELATED PATENT APPLICATIONS

Related patent applications include the following (each of which is incorporated by reference herein) as well as the prior art cited in each.

U.S. Ser. No. 07/798,300 filed Nov. 22, 1991 by Texaco Inc as assignee of Michael K. Porter et al is directed to hydroconversion of heavy hydrocarbon oil using a heterogeneous catalyst plus an oil-miscible catalyst.

U.S. patent Ser. No. 07/844,092 filed Mar. 2, 1992 by Texaco as assignee of Ajit K. Bhattacharya et al is directed to hydroconversion of heavy hydrocarbon oil in the presence of an aromatic additive oil such as heavy cycle gas oil (HCGO).

BACKGROUND PRIOR ART

Related background prior art (incorporated herein by reference) includes the following patents as well as the prior art cited in each:

U.S. Pat. No. 4,703,027 issued Oct. 27, 1987 to Texaco Inc as assignee of Edward T. Marquis et al.

U.S. Pat. No. 4,891,437 issued Jan. 2, 1990 to Texaco Inc as assignee of Edward T. Marquis et al.

FIELD OF THE INVENTION

This invention relates to the hydroconversion of hydrocarbon streams. More particularly it relates to a technique for integrating hydroconversion processes with other refining processes which generate waste catalyst.

BACKGROUND OF THE INVENTION

As is well known to those skilled in the art, olefinic hydrocarbons typified by propylene, may be epoxidized by reaction with a hydroperoxide, such as t-butyl hydroperoxide, in the presence of catalyst containing molybdenum.

U.S. Pat. No. 4,891,437, which issued to Texaco Inc as assignee of Edward T. Marquis et al, discloses use of a catalyst containing 50–1,000 ppm of molybdenum. Illustrative catalysts mentioned include molybdenum compositions which are soluble in the reaction medium including "molybdenum octoate, molybdenum naphthenate, molybdenum acetyl acetonate, molybdenum-/alcohol complexes, molybdenum/glycol complexes, etc." Also noted are complexes such as described in U.S. Pat. No. 4,626,506 and U.S. Pat. No. 4,650,886 and 4,654,427 incorporated herein by reference.

U.S. Pat. No. 4,703,027, which issued to Texaco Inc as assignee of Edward T. Marquis et al, also discloses catalyst complexes which are useful for epoxidation of e.g. propylene to propylene oxide.

While the molybdenum compounds so used are found to be effective catalysts to convert e.g. propylene to propylene oxide, their use raises a problem. The work-up of the reaction mixture leaves behind a residual catalyst composition containing valuable molybdenum values. It has heretofore been found to be difficult to dispose of the composition because of the toxic nature of the heavy metal content. Furthermore the treatment of this composition to recover the metal (and other values) of this composition has not heretofore been economically possible.

It is an object of this invention to provide a process for economically utilizing these compositions in manner to minimize the disposal problems heretofore associated therewith. Another object of this invention is to provide an improved hydroconversion process utilizing these compositions. Other objects will be apparent to those skilled in the art.

STATEMENT OF THE INVENTION

In accordance with certain of its aspects, this invention is directed to a method of catalytically hydroconverting a charge hydrocarbon oil containing a substantial quantity of components boiling above about 1000° F. in an ebullated bed to convert a substantial portion thereof to product containing components boiling below 1000° F., said product being characterized by an undesirably high content of sediment-forming components which comprises passing said charge hydrocarbon oil containing a substantial quantity of components boiling above about 1000° F. into contact in a conversion zone with (i) a solid heterogeneous catalyst containing a metal of Group IV-B, V-B, VI-B, VII-B, or VIII on a support and (ii) as an oil-miscible catalyst a molybdenum complex, said oil-miscible catalyst being present in amount sufficient to provide metal in amount of less than about 60 wppm, based on charge hydrocarbon oil;

maintaining said charge hydrocarbon oil containing a substantial quantity of components boiling above about 1000° F. in said conversion zone at conversion conditions in the presence of hydrogen and mercaptan as a substantial portion of said components boiling above about 1000° F. are converted to components boiling below 1000° F. thereby forming product containing a substantial portion of components boiling below about 1000° F. and a content of sediment-forming components which is less than would be formed in the absence of said oil-soluble catalyst; and recovering said product containing a substantial portion of components boiling below about 1000° F.;

wherein said oil-miscible catalyst contains a complex of molybdenum which has been recovered from a reaction mixture wherein it has catalyzed the epoxy-forming reaction of a $C_3$–$C_{20}$ olefin charge stock and an organic peroxide or hydroperoxide.

DESCRIPTION OF THE INVENTION

It has been found that the catalyst residue from the epoxidation of an olefin charge stock may be employed as an oil-miscible/oil soluble component of the catalyst employed in hydroconversion of heavy hydrocarbons.

The charge to the epoxidation reaction (from which the catalyst residue is recovered and passed to hydroconversion) is typically an olefinic hydrocarbon such as a $C_3$–$C_{20}$ olefin, typified by a $C_3$–$C_{20}$ linear alkene such as propylene.

Epoxidation is typically effected by charging (i) 0.5–2, preferably 0.9–1.8, most preferably 1.05–1.35, moles, say 1.2 moles of $C_3$–$C_{20}$ olefin, preferably a linear mono-olefin, typified by propylene and (ii) 1 mole of $C_4$–$C_5$ tertiary alkyl hydroperoxide, typified by t-butyl hydroperoxide or t-amyl hydroperoxide.

There is also added to the epoxidation reaction, as catalyst, the complex of (i) a low molecular weight linear saturated diol and (ii) a molybdenum compound which may be an oxide of molybdenum, an acid of molybdenum, or an alkali metal or ammonium salt of an acid of molybdenum.

The lower molecular weight linear saturated diol may contain 2–8 carbon atoms. The preferred diols may be propylene glycol or more preferably ethylene glycol.

The molybdenum oxide may be molybdenum sesquioxide $Mo_2O_3$, molybdenum dioxide $MoO_2$, molybdenum trioxide $MoO_3$, molybdenum pentoxide $Mo_2O_5$, or molybdenum blue oxide $MoO_{2.5-3}.XH_2O$. The acid of molybdenum may be $H_2MoO_4$ (or $MoO_3.H_2O$) or $H_2MoO_4.H_2O$ (or $MoO_3.2H_2O$). The ammonium molybdate may be $(NH_4)_2$ $MoO_4$, $(NH_4)_2$ $Mo_2O_7$, $(NH_4)_6$ $Mo_7O_{24}.4H_2O$, etc. The preferred molybdenum compound may be ammonium molybdate $(NH_4)_2$ $MoO_4$, ammonium dimolybdate $(NH_4)_2Mo_2O_7$ or sodium molybdate $Na_2$ $MoO_4$.

The catalyst for the epoxidation of the charge olefin to the product olefin oxide may be formed by heating a mixture of 4–20 moles, preferably 8–16 moles, say 10 moles of low molecular weight saturated diol and one mole of moiybdenum compound to 50° C.–150° C., preferably 90° C.–120° C., say 100° C. at 10–50 psig, preferably 14–15 psig, say 14.7 psig for 0.1–24 hours, preferably 0.5–1.5 hours, say 1 hour. Typically the diol is present in substantial excess to provide a final reaction product catalyst in that excess of diluent/solvent. That final reaction product typically contains 3–15 w % preferably 6–12 w %, say 9 w % of by-product water. The liquid reaction mixture is cooled to about 40°–50° C. and then heated under vacuum to about 100° C. to remove water as overhead.

The catalyst as prepared is typically a clear, light yellow solution which contains 5–25 w %, preferably 10–15 w %, say 12 w % molybdenum; 0–3 w %, preferably 0–0.3 w %, say 0.16 w % alkali metal such as sodium; 20–50 w %, preferably 25–45 w %, say 45 w % of complex, 25–75 w %, preferably 40–60 w %, say 55 w % of unreacted diol; 0.1–3 w %, preferably 0.5–2 w %, say 1 w % of water; and it typically has an acid number of greater than about 50, preferably 50–150, say 100. Levels of acid may be as high as 5 w %—formic acid, acetic acid, and isohutyric acids may be present typically in amounts respectively of 3 w %, 0.5 w %, and 0.2 w %. Sap. No may be as high as 220 mg. KOH/g. Heavy metals may he present in amount up to 10–15 wppm. Typically the mix may contain Fe (4 ppm), Cr (<1 ppm) and Ni (4 ppm). The viscosity may he 130 cs/100° F. or 21 cs/150° F. pH is typically 2–3, say 2.8. Specific Gravity is typically about 1.07 at 150° F. $\overline{M}_n$ is typically about 180.

This catalyst (0.01–0.10w %, preferably 0.02–0.06 w %, say 0.03 w %) is added to the epoxidation reaction mixture which may be charged together with $C_3$–$C_{20}$ olefin and with at least a 30 w % solution of hydroperoxide charge stock in the corresponding product alcohol. The mixture may contain about 0.5 to about 2 moles of charge olefin per mole of charge hydroperoxide and may contain more than 60 w % hydroperoxide charge, product alcohol, and product epoxide combined.

The mixture is heated to 50°C.–180° C., preferably 90° C.–140° C., say 120° C. and 50–1000 psig, preferably 100–600 psig, say 500 psig for 0.5–10 hours, preferably 0.5–4 hours, say 2 hours. The epoxide concentration may be 10–40 w %, preferably 20–35 w %, say 30 w %. During this time, the charge olefin is epoxidized. In the typical embodiment, propylene and t-butyl hydroperoxide or t-butyl peroxide or t-amyl peroxide react (in the presence of catalyst) to form propylene oxide. The product reaction mixture also contains unreacted t-butyl hydroperoxide (or t-butyl peroxide or t-amylperoxide) and by-product t-butyl alcohol and di-t-butyl peroxide (or the amyl analogues). In addition, it contains the catalyst residue.

Work-up of the reaction mixture is typically effected by heating to 110° C.–180° C., preferably 110° C.–150° C., say 130° C. at 300–1000 psig, preferably 300–600 psig, say 500 psig to strip off volatile components. In the preferred embodiment these may include propylene oxide (b.p 34° C.), ethylene glycol (b.p. 197° C.), t-butyl alcohol (b.p. 83° C.), water (b.p. 100° C.) and di-t-butyl peroxide (b.p 109° C.). (This stream may be further distilled to permit recovery of the desired propylene oxide product).

The catalyst waste stream, after partial stripping, may typically be a liquid containing the following:

(i) 2–5 w %, preferably 2–4 w %, say 3.4 w % molybdenum;

(ii) 0–0.6 w %, preferably 0–0.06 w %, say 0.03 w % alkali metal, typically sodium;

(iii) 0.1–3 w %, preferably 0.1–2 w %, say 1 w % water;

(iv) 0.5–10 w %, preferably 1–5 w %, say 3 w % oxygenates (including carboxylic acids, esters such as methyl formate, ethers, etc);

(v) 80–96 w %, preferably 85–95 w %, say 92 w % of unreacted diol plus by-product alcohol.

The above catalyst waste stream may contain glycols, alcohols, ethers, carboxylic acids, esters and water. It may usually be very acidic with pH about 2–4, say 2.8 and with acid number of 50 to about 250, say 220 mg KOH/g of sample. Levels of formic, acetic and isobutyric acids may be say 3, 0.5 and 0.2 w %, respectively Saponification value may be 100–1000, say 220 mg KOH/g of sample. Traces of iron (say 4 ppm), chromium (say 1 ppm) and nickel (say 4 ppm) may be present. Viscosity may be 80–150 cs, say 130 cs at 100° F. and 10–40, say 21 cs at 150° F. Specific gravity may be 1.07 at 150° F. Number average molecular weight may be 150–400, preferably 160–200, say 180.

This catalyst residue is miscible with or soluble in heavy hydrocarbons.

When recovered from the epoxidation of the charge alkenes, it is not readily possible to reactivate or to regenerate this composition and to utilize the so reactivated or regenerated catalyst because the reactivated or regenerated catalyst is found to be poorly selective for epoxidation and it undesirably yields more by-product (e.g. dimers) resulting from side reactions. Furthermore, solids tend to precipitate from the catalyst solution.

Furthermore, it is not economically possible to discard the catalyst and to recover the metal values therein; separation of desired components is very complex, time-consuming, and expensive because the metal values are present as highly complexed compositions which are difficultly handleable because of high viscosity, low stability, etc.

It is not possible to dump the residue because the content of heavy metal (molybdenum) makes the residue environmentally toxic.

It is a feature of this invention, that it has been found that this catalyst residue may be employed as the so-called soluble/miscible molybdenum catalyst in the hydroconversion of heavy oils—and that when so employed, it permits attainment of unexpected advantages.

As is well known to those skilled in the art, the petroleum refiner wishes to convert high boiling fractions such as vacuum resid to lower boiling fractions which are of higher value and more readily handleable and/or marketable. Illustrative of the large body of prior art patents incorporated herein by reference) directed to this problem are the following:

U.S. Pat. No. 4,579,646 discloses a bottoms visbreaking hydroconversion process wherein hydrocarbon charge is partially coked, and the coke is contacted within the charge stock with an oil-soluble metal compound of a metal of Group IV-B, V-B, VII-B, or VIII to yield a hydroconversion catalyst.

U.S. Pat. No. 4,724,069 discloses hydrofining in the presence of a supported catalyst bearing a VI-B, VII-B, or VIII metal on alumina, silica, or silica-alumina. There is introduced with the charge oil, as additive, a naphthenate of Co or Fe.

U.S. Pat. No. 4,567,156 discloses hydroconversion in the presence of a chromium catalyst prepared by adding a water-soluble aliphatic polyhydroxy compound (such as glycerol) to an aqueous solution of chromic acid, adding a hydrocarbon thereto, and heating the mixture in the presence of hydrogen sulfide to yield a slurry.

U.S. Pat. No. 4,564,441 discloses hydrofining in the presence of a decomposable compound of a metal (Cu, Zn, III-B, IV-B, VI-B, VII-B, or VIII) mixed with a hydrocarbon-containing feed stream; and the mixture is then contacted with a "suitable refractory inorganic material" such as alumina.

U.S. Pat. No. 4,557,823 discloses hydrofining in the presence of a decomposable compound of a IV-B metal and a supported catalyst containing a metal of VI-B, VII-B, or VIII.

U.S. Pat. No. 4,557,824 discloses demetallization in the presence of a decomposable compound of a VI-B, VII-B, or VIII metal admitted with the charge and a heterogeneous catalyst containing a phosphate of Zr, Co, or Fe.

U.S. Pat. No. 4,551,230 discloses demetallization in the presence of a decomposable compound of a IV-B, V-B, VI-B, VII-B, or VIII metal admitted with the charge and a heterogeneous catalyst containing $NiAs_x$ on alumina.

U.S. Pat. No. 4,430,207 discloses demetallization in the presence of a decomposable compound of a V-B, VI-B, VII-B, or VIII metal admitted with the charge and a heterogeneous catalyst containing a phosphate of Zr or Cr.

U.S. Pat. No. 4,389,301 discloses hydroprocessing in the presence of added dispersed hydrogenation catalyst (typically ammonium molybdate) and added porous contact particles (typically FCC catalyst fines, alumina, or naturally occurring clay).

U.S. Pat. No. 4,352,729 discloses hydrotreating in the presence of a molybdenum blue solution in polar organic solvent introduced with the hydrocarbon charge.

U.S. Pat. No. 4,338,183 discloses liquefaction of coal in the presence of unsupported finely divided metal catalyst.

U.S. Pat. No. 4,298,454 discloses hydroconversion of a coal-oil mixture in the presence of a thermally decomposable compound of a IV-B, V-B, VI-B VII-B, or VIII metal, preferably Mo.

U.S. Pat. No. 4,134,825 discloses hydroconversion of heavy hydrocarbons in the presence of an oil-soluble compound of IV-B, V-B, VI-B, VII-B, or VIII metal added to charge, the compound being converted to solid, non-colloidal form by heating in the presence of hydrogen.

U.S. Pat. No. 4,125,455 discloses hydrotreating in the presence of a fatty acid salt of a VI-B metal, typically molybdenum octoate.

U.S. Pat. No. 4,077,867 discloses hydroconversion of coal in the presence of oil-soluble compound of V-B, VI-B, VII-B, or VIII metal plus hydrogen donor solvent.

U.S. Pat. No. 4,067,799 discloses hydroconversion in the presence of a metal phthalocyanine plus dispersed iron particles.

U.S. Pat. No. 4,066,530 discloses hydroconversion in the presence of (i) an iron component and (ii) a catalytically active other metal component prepared by dissolving an oil-soluble metal compound in the oil and converting the metal compound in the oil to the corresponding catalytically active metal component.

Assignee's patent application Ser. No. 07/694,591 teaches that under the conditions of operation therein set forth (note e.g. Examples II–IV* and related Table II in particular), it is possible to attain improvements (in e.g. conversion and other factors) by addition to the heterogeneous catalyst of an oil-soluble catalyst in amount of 10–200 wppm. In particular, Example I shows that it is possible to attain much higher conversion when using 160 wppm of molybdenum additive.

The charge which may be subjected to hydroconversion by the process of this invention may include high boiling hydrocarbons typically those having an initial boiling point (ibp) above about 650° F. This process is particularly useful to treat charge hydrocarbons containing a substantial quantity of components boiling above about 1000° F. to convert a substantial portion thereof to components boiling below 1000° F.

Typical of these streams are heavy crude oil, topped crude, atmospheric resid, vacuum resid, asphaltenes, tars, coal liquids, visbreaker bottoms, etc. Illustrative of such charge streams may be a vacuum resid obtained by blending vacuum resid fractions from Alaska North Slope Crude (59v %), Arabian Medium Crude (5v %), Arabian Heavy Crude (27%), and Bonny Light Crude (9v %) having the characteristics listed in Table I:

TABLE I

| PROPERTY | Charge |
|---|---|
| API Gravity | 5.8 |
| 1000° F. + (W %) | 93.1 |
| Composition (W %) | |
| C | 84.8 |
| H | 10.09 |
| N | 0.52 |
| S | 3.64 |
| Alcor Microcarbon Residue (McR) (%) | 19.86 |
| n-$C_7$ insolubles (%) | 11.97 |
| Metals content (wppm) | |
| Ni | 52 |
| V | 131 |
| Fe | 9 |
| Cr | 0.7 |
| Na | 5 |

It is a feature of these charge hydrocarbons that they contain undesirable components typified by nitrogen (in amount up to 1w %, typically 0.2–0.8 w %, say about 0.52 w %), sulfur (in amount up to 10 w %, typically 2–6 w %, say about 3.64 w %), and metals including Ni, V, Fe, Cr, Na, etc. in amounts up to 900 wpm, typically 40–400 wppm, say 198 wppm). The undesirable asphaltene content of the charge hydrocarbon may be as high as 22 w %, typically 8–16 w %, say 11.97 w % (analyzed as components insoluble in normal heptane).

The API gravity of the charge may be as low as minus 5, typically minus 5 to plus 35, say about 5.8. The content of components boiling above about 1000° F. may be as high as 100 w %, typically 50–98+w %, say 93.1 w %. The Alcor MCR Carbon content may be as high as 30 w%, typically 15–25 w %, say 19.86 w %.

In practice of the method of this invention, the charge hydrocarbon oil may be passed to a hydroconversion operation wherein conversion occurs in liquid phase at conversion conditions including 700° F.–850° F., preferably about 750° F.–810° F., say 800° F. at hydrogen partial pressure of about 500–5000 psig, preferably about 1500–2500 psig, say 2000 psig.

Hydroconversion is typically carried out in the presence of solid heterogenous catalyst containing a metal of Group IV-B,V-B, VI-B, VII-B, or VIII on a support. Commonly the catalyst includes alumina bearing a Group VIII metal and a Group VI-B metal. In a typical embodiment, the alumina support may be loaded with metals to yield a product catalyst containing a Group VIII oxide in amount of 3–6 w %, preferably 3–5 w %, say 3.2 w % and a Group VI-B metal oxide in amount of 14.5–24, preferably 14.5–16 w %, say 5.2 w %.

The Group VIII metal may be a non-noble metal such as iron, cobalt, or nickel, or a noble metal such as ruthenium, rhodium, palladium, osmium, iridium, or platinum. This metal may be loaded onto the alumina typically from a 1.0%–50%, say 3.0% aqueous solution of a water-soluble salt (e.g. a nitrate, acetate, oxalate etc.). The preferred metal may be nickel, employed as a 30 w % aqueous solution of nickel nitrate.

The Group VI-B metal may preferably be chromium, molybdenum, or tungsten. This metal may be loaded onto the alumina typically from a 10%–25%, say 15% aqueous solution of a water-soluble salt such as ammonium molybdate.

It is a feature of the method of this invention that there is added to the charge hydrocarbon oil (preferably prior to admission to hydroconversion) a catalytically effective amount of an oil-miscible/soluble catalyst waste residue obtained supra from the epoxidation of alkenes. This catalyst residue, detailed supra, is found to be soluble in or miscible with the charge hydrocarbon oil.

The catalyst residue is oil-miscible and typically oil-soluble i.e. it is soluble in the charge hydrocarbon oil in amount of at least 0.01 g, preferably 0.025–0.25, say about 0.1 g per 100 g of charge hydrocarbon oil—or alternatively it is readily dispersible in the charge hydrocarbon in at least these amounts. It is also a feature of these residues that, when activated as hereinafter set forth, the activated residues are also oil-miscible in the hydrocarbon oils with which they come into contact during practice of the method of this invention.

It is a feature of the process of this invention that if the molybdenum metal in the oil-miscible residue is present in amount less than about 60 wppm (i.e. of metal) say 10–60 wppm based on hydrocarbon oil to be hydroconverted, unexpected results may be achieved. It is unexpectedly found, if the noted amount of molybdenum is 15–60, preferably 30–60, most preferably 45 wppm, that the power consumption in the ebullated bed process is decreased. Specifically the total power (i.e. thermal energy) required to maintain the reaction temperature at set point in the ebullated bed, may be decreased from ca 1200 KBTU/BBL per hour (which is the power consumption at 0 ppm metal) down to a minimum of about 1000 KBTU/BBL per hour. This is an improvement of about 24% in power saving. This is attained at a conversion of 61.2v % which is 11% greater than the base line conversion of 54.6v %; and it is also noted that the sediment remains about the same.

It is a particular feature of the process of this invention that it is unexpectedly found that the optimum conversion may be achieved if the noted amount of molybdenum (expressed as) metal is 15–60, preferably 30–60, say 30 wppm.

Conversion is calculated as [the percentage of 1000° F.+material in the feed minus the percentage of 1000° F.+material in the Product] divided by the percentage of 1000° F.+material in the feed.

In addition to these improvements which may be attained in conversion and power consumption, it is particularly significant that improvement in the level of sediment in the product oils is attained. It is unexpectedly found that sediment formation in the effluent from the ebullated bed may be minimized by use of added soluble metal complex in amount sufficient to provide a molybdenum metal content of 15–30 wppm, preferably about 15 wppm. It is found for example that the sediment in the product oil when 15 wppm of metal is present is only about (0.037/0.092 or) 40% of that observed for the base case.

Sediment in the effluent from the ebullated bed is measured by IP Test 375/86 entitled Total Sediment Residual Fuel Oils.

It will be apparent to those skilled in the art that the level of soluble molybdenum metal, in the 15–60 wppm range, which will be employed will depend upon the particular charge to the ebullated bed, the power consumed, and the conversion attained. In any instance, an economic study will permit a ready determination of the desired level of soluble metal to be employed. It is to be noted however that in most instances, while the conversion and the power consumption are significant, it is usually found that the sediment levels in the product will be determinative. This is because undesirably high level of sediment will result in plugging of various pieces of equipment with resulting short run times; and this factor may be found to be economically controlling-especially so when the feed is characterized by a high propensity to generate sediment.

For these reasons, it will generally be preferred to operate with a soluble molybdenum metal feed of 15–30 wppm, say 30 wppm, as this will give good conversion and power consumption at best sediment levels—although 30 wppm gives only slightly more sediment at satisfactory levels of conversion and power consumption as compared to 15 wppm.

It is possible in practice of the process of this invention to introduce the oil-miscible molybdenum metal compound as a solution/mixture thereof with an aromatic additive oil. The aromatic additive oil which may be employed, typically those oils which contain sulfur such as a heavy cycle gas oil (HCGO), may be characterized as follows:

TABLE

| Property | Value | | |
|---|---|---|---|
| | Broad | Narrow | Typical |
| API Gravity | −5 to 20 | 0–10 | 2 |
| Temperature °F. | | | |
| ibp | 500–1000 | 650–850 | 650 |
| 50% | 700–950 | 825–875 | 850 |

TABLE-continued

| Property | Value | | |
|---|---|---|---|
| | Broad | Narrow | Typical |
| ep | 1000–1200 | 1000–1100 | 1050 |
| Aromatics Content w % | 25–90 | 30–85 | 85 |
| Sulfur Content w % | 0.5–5 | 2–4 | 3.5 |

Illustrative aromatic additive oils which may be employed may include:

TABLE

| | Value |
|---|---|
| A-Heavy Cycle Gas Oil | |
| API Gravity | −3.0 |
| Temp °F. | |
| ibp | 435 |
| 10% | 632 |
| 50% | 762 |
| 90% | 902 |
| ep | 1056 |
| Aromatics Content w % | 85 |
| Sulfur Content w % | 2.5–3.5 |
| B-MP Extract | |
| API Gravity | 8 |
| Temp °F. | |
| ibp | 600 |
| ep | 1000 |
| Aromatics Content w % | 50–90 |
| Sulfur Content w % | 3 |
| C-Decant Oil | |
| API Gravity | -2.7 |
| Temp °F. | |
| ibp | 525 |
| 10% | 708 |
| 50% | 935 |
| 90% | 975 |
| ep | 1100 |
| Aromatics Content w % | 80 |
| Sulfur Content w % | 1.75 |

The metal complex may be added in amount to form a solution/mixture with the heavy oil of 0.01 w %–0.04 w %, preferably 0.01 w %–0.03 w %, say 0.02 w %. The metal complex may be added to the heavy oil and stored and used in the form of the solution/mixture therewith. When this is added to the charge hydrocarbon oil to hydrotreating, the amount added may be 5 w %–20 w %, preferably 15 w %, say 13 w % of solution/mixture which will provide the 10–60 wppm of molybdenum desired to effect the results noted supra.

Activation of the oil-miscible complex in accordance with practice of the process of this invention may be effected either by pre-treatment (prior to hydroconversion) or in situ (during hydroconversion). It is preferred to effect activation in situ in the presence of the hydroconversion catalyst to achieve a highly dispersed catalytic species.

Activation according to the preferred method may be carried out by adding metal complex (in amount to provide desired molybdenum content) to charge hydrocarbon at 60° F.–300° F., say 200° F. The mixture is activated by heating to 400° F.–835° F., typically 500° F.–700° F., say 600° F. at partial pressure of hydrogen of 500–5000 psig, typically 1000–3000 psig, say 2000 psig and at partial pressure of a gaseous mercaptan of 5–500 psig, typically 10–300 psig, say 50 psig. Total pressure may be 500–5500 psig, typically 1000–3300 psig, say 2650 psig. Commonly the gas may contain 40–99v %, typically 90–99v %, say 98v % hydrogen and 1–10v %, say 2v % mercaptan such as hydrogen sulfide. Time of activation may be 1–12, typically 2–6, say 3 hrs.

In this embodiment, it will be noted that activation may occur at temperature which is lower than the temperature of conversion.

The mercaptans which may be employed may include hydrogen sulfide, aliphatic mercaptans, typified by methyl mercaptan, lauryl mercaptan, etc. aromatic mercaptans; dimethyl disulfide, carbon disulfide, etc.

These mercaptans apparently decompose during the activation process. It is not clear why this treatment activates the metal complex. It may be possible that the activity is generated as a result of metal sulfides formed during the treatment.

When the sulfur content of the charge hydrocarbon is above about 2 w %, it may not be necessary to add a mercaptan during activation i.e. hydrodesulfurization of the charge may provide enough mercaptan to properly activate (i.e. sulfide) the oil-miscible decomposable complex.

It is possible to activate the oil-miscible metal complex in the solution/mixture with the heavy aromatic oil. Activation may be effected under the same conditions as are used when activation is carried out in the charge stream), the compatible oil containing the now activated metal may be admitted to the charge stream in amount sufficient to provide therein activated oil-miscible metal compound in desired amount.

In still another embodiment, activation may be carried out by subjecting the charge hydrocarbon oil containing the oil-miscible metal complex to hydroconversion conditions including temperature of 700° F.–850° F., preferably about 750° F.–810° F., say 800° F. at hydrogen partial pressure of about 500–5000 psig, preferably about 1500–2000 psig, say 2000 psig—in the presence of a mercaptan but in the absence of heterogeneous hydroconversion catalyst.

In the preferred embodiment, activation may be carried out during hydroconversion i.e. in the presence of the heterogeneous, hydroconversion catalyst, hydrogen, and mercaptan.

Hydroconversion is carried out in the presence of solid heterogeneous catalyst containing, as a hydrogenating component, a metal of Group IV-B, V-B, VI-B, VII-B, or VIII on a support which may typically contain carbon or an oxide of aluminum, silicon, titanium, magnesium, or zirconium. Preferably the catalyst contains a metal of Group VI-B and VIII - typically nickel and molybdenum.

When the metal is a Group IV-B metal, it may be titanium (Ti) or zirconium (Zr).

When the metal is a Group V-B metal, it may be vanadium (V), niobium (Nb), or tantalum (Ta).

When the metal is a Group VI-B metal, it maybe chromium (Cr), molybdenum (Mo), or tungsten (W) .

When the metal is a Group VII-B metal, it maybe manganese (Mn) or rhenium (Re) .

When the metal is a Group VIII metal, it may be a non-noble metal such as iron (Fe), cobalt (Co), or nickel (Ni) or a noble metal such as ruthenium (Ru), rhodium (Rh), palladium (Pd), osmium (Os), iridium (Ir), or platinum (Pt).

The solid heterogeneous catalyst may also contain, as a promoter, a metal of Groups I-A, I-B, II-A, II-B, or V-A.

When the promoter is a metal of Group I-A, it may preferably be sodium (Na) or potassium (K).

When the promoter is a metal of Group IB, it may preferably be copper (Cu).

When the promoter is a metal of Group II-A, it may be beryllium (Be), magnesium (Mg), calcium (Ca), strontium (Sr), barium (Ba), or radium (Ra).

When the promoter is a metal of Group II-B, it may be zinc (Zn), cadmium (Cd), or mercury (Hg).

When the promoter is a metal of Group IV-B, it may be titanium (Ti), zirconium (Zr), or hafnium (Hf);

When the promoter is a metal of Group V-A, it may preferably be arsenic (As), antimony (Sb), or bismuth (Bi).

The hydrogenating metal may be loaded onto the solid heterogeneous catalyst by immersing the catalyst support in solution (e.g. ammonium heptamolybdate) for 2–24 hours, say 24 hours, followed by drying at 60° F.–300° F. say 200° F. for 1–24 hours, say 8 hours and calcining for 1–24 hours, say 3 hours at 750° F.–1100° F., say 930° F.

The promoter metal may preferably be loaded onto the solid heterogeneous catalyst by immersing the catalyst support (preferably bearing the calcined hydrogenating metal—although they may be added simultaneously or in any order) in solution (e.g. bismuth nitrate) for 2–24 hours, say 24 hours, followed by drying at 60° F.–300° F., say 200° F. for 1–24 hours, say 3 hours, and calcining at 570° F.–1100° F., say 750° F. for 1–12 hours, say 3 hours.

The solid heterogenous catalyst employed in the method of this invention may be characterized by a Total Pore Volume of 0.2–1.2 cc/g, say 0.77 cc/g; a Surface Area of 50–500 $m^2/g$, say 280 $m^2/g$; and a Pore Size Distribution as follows:

| Pore Diameter Å | Volume cc/g |
|---|---|
| 30–100 | 0.15–0.8, say 0.42 |
| 100–1000 | 0.10–0.50, say 0.19 |
| 1000–10,000 | 0.01–0.40, say 0.16 |

In another embodiment, it may have a pore size distribution as follows:

| Pore Diameter Å | Pore Volume cc/g | Typical |
|---|---|---|
| >250 | 0.12–0.35 | 0.28 |
| >500 | 0.11–0.29 | 0.21 |
| >1500 | 0.08–0.26 | 0.19 |
| >4000 | 0.04–0.18 | 0.11 |

The solid heterogeneous catalyst typically may contain 4–30 w %, say 9.5 w % Mo, 0–6 w %, say 3.1 w % Ni and 0–6 w %, say 3.1 w % of promoter metal e.g. bismuth. Liquid hourly space velocity (LHSV) in the hydroconversion reactors may be 0.1–2, say 0.7. Preferably the heterogeneous catalyst may be employed in the form of extrudates of diameter of 0.7–6.5 mm, say 1 mm and of length of 0.2–25 mm, say 5 mm.

Although it is possible to carry out hydroconversion in a fixed bed, a moving bed, a fluidized bed, or a well-stirred reactor, it is found that the advantages of this invention may be most apparent when hydroconversion is carried out in an ebullated bed.

It is a feature of the process of this invention that hydroconversion may be carried out in one or more beds. It is found that the active form of the catalyst is formed in or accumulates in the first of several reactors; and accordingly increases in conversion and hetero atom removal activities appear principally to occur in the first of several reactors.

Effluent from hydroconversion is typically characterized by an increase in the content of liquids boiling below 1000° F. Commonly the w % conversion of the 1000° F.+boiling material is 30%–90%, say 67% which is typically 5%–25%, say 12% better than is attained by the prior art techniques.

It is a feature of this invention that it permits attainment of improved removal of sulfur (HDS Conversion), of nitrogen (HDN Conversion), and of metals (HDNi and HDV Conversion). Typically HDS Conversion may be 30–90%, say 65% which is 1%–10%, say 4% higher than the control runs. Typically HDN Conversion may be 20%–60%, say 45% which is 1%–10%, say 4% higher than control runs. Typically HDNi plus HDV Conversion may be 70%–99%, say 90% which is 5%–20%, say 13% higher than control runs.

It is however particularly a feature of the process of this invention that it permits attainment of improvements in Conversion and Power Consumption—but more importantly in most instances substantial decrease in the sediment content of the effluent from an ebullated bed.

Practice of the method of this invention will be apparent to those skilled in the art from the following wherein, as elsewhere in this specification unless otherwise stated, all parts are parts by weight. An asterisk designates a control example.

EXAMPLE I*

In this control example I, the feedstock is a blend of (i) 87 w % of Arab Medium Vacuum Resid (ibp≧1000° F.) and (ii) 13 w % of Heavy Cycle Gas Oil (HCGO) having the following properties:

TABLE

| Property | Value |
|---|---|
| API Gravity | 10.0 |
| >1000° F. w % | 94 |
| Composition w % | |
| C | 82.56 |
| H | 9.99 |
| N | 0.35 |
| S | 5.40 |
| Alcor Microcarbon Residue (MCR) % | 22.8 |
| Metals Content wppm | |
| Ni | 43.2 |
| V | 130.2 |
| Fe | 11.7 |

The charge hydrocarbon feedstock is admitted to the ebullated reaction bed at 785° F. at 2250 psig. Hydrogen is admitted at 6300 SCFB and the liquid hourly space velocity (LHSV) is about 0.5 per hour.

Supported catalyst in the ebullated bed is cylinders (0.8 mm diameter and 15 mm length) of catalyst containing 3.1 w % nickel, 4.4 w % molybdenum, 6.6 w % vanadium, 9.7 w % sulfur, 0.5 w % nitrogen, 26.7 w % carbon, and 2 w % hydrogen on alumina. This is a typical catalyst withdrawn from a commercial ebullated bed reactor unit. Surface Area is about 50 $m^2/g$ and Total Pore Volume is about 0.2 cc/g.

Catalyst is activated in situ during hydroconversion.

EXAMPLE II

In this experimental Example, the hydroconversion procedure of Examples I is repeated—except that three pulses of a waste stream from a propylene epoxidation unit are added at intervals as set forth in the table which follows.

The waste stream, in which serves as catalyst, is recovered from a unit in which 100 moles of propylene is epoxidized with 120 moles of t-butyl hydroperoxide at 120° C. and 500 psig for 2 hours in the presence of a catalyst which is prepared by heating a mixture of 10 moles of ethylene glycol and one mole of ammonium molybdate $(NH_4)_2MoO_4$ for 1 hour.

Work-up of the reaction effluent (after the reaction between the propylene and the t-butyl peroxide in the presence of the molybdenum/ethylene glycol complex catalyst) is carried out by heating to 110° C. at 500 psig to distill off volatile components including (i) desired product propylene oxide (ii) unreacted components including propylene, t-butyl peroxide, etc. and (iii) by products including t-butyl alcohol, etc.

The residue waste stream (WS) is found to contain 3.4 w % molybdenum (in the form of an oil-soluble/miscible oxygenate complex). This stream contains formic acid (3 w %), acetic acid (0.5 w %), and isobutyric acid (0.2 w %) and it has a sap No. of 220 mg KOH/g of sample. pH is 2.8; viscosity is 130 CS at 100° F. and 21 cs at 150° F. Specific Gravity is 1.07 at 150° F. Molecular weight $\overline{M}_n$ is 180.

The total amount of waste stream (WS) catalyst added to the hydroconversion operation during each pulse is 0.176 w% containing 60 wppm oil-soluble/dispersible molybdenum. The catalyst is activated in situ at reaction temperature of hydroconversion.

Product is recovered from hydroconversion and analyzed to determine the Conversion, the hydrodesulfurization (HDS), the hydrodevanadization (HDV), the hydrodenickelization (HDNi) and the sediment content.

TABLE

| EXAMPLE | Time Hr | W.S W % | WPPM Mo |
|---|---|---|---|
| I | 0 | 0 | 0 |
| | 30 | 0 | 0 |
| | 78 | 0 | 0 |
| II | 0 | 0 | 0 |
| | 30 | 0 | 0 |
| | 72 | 0.176 | 60 |
| | 96 | 0 | 0 |
| | 108 | 0.176 | 60 |
| | 126 | 0 | 0 |
| | 141 | 0.176 | 60 |
| | 160 | 0 | 0 |

TABLE

| | EXAMPLE I | |
|---|---|---|
| | At 0 Hours | At 78 Hours |
| Conversion w % | 40.53 | 40.53 |
| HDS W % | 47.78 | 44.07 |
| HDV W % | 65.92 | 65.82 |
| HDNi W % | 44.98 | 44.68 |
| Sediment W % | 3.89 | 4.20 |

TABLE

| | EXAMPLE II | |
|---|---|---|
| | At 0 Hours | At 160 Hours |
| Conversion W % | 41.38 | 63.44 |
| HDS W % | 47.22 | 50.55 |
| HDV W % | 65.36 | 74.76 |
| HDNi W % | 39.74 | 45.22 |
| Sediment W % | 3.07 | 3.07 |

From the above Tables, it is apparent that over the course of the extended run of Control Example I, the conversion remained level, the HDS, HDV, and HDNi decreased, and the Sediment increased.

In stark contrast, the run of Experimental Example II (utilizing the technique of this invention) shows that (i) the Conversion increased very significantly by 63.44/41.38 or 153% (!) while the Sediment stayed constant. During this run, the HDS, HDV, and HDNi increased respectively by 107%, 114%, and 114%.

Although this invention has been illustrated by reference to specific embodiments, it will be apparent to those skilled in the art that various changes and modifications may be made which clearly fall within the scope of the invention.

What is claimed:

1. The method of catalytically hydroconverting a charge hydrocarbon oil containing a substantial quantity of components boiling above about 1000° F. in an ebullated bed to convert a substantial portion thereof to product containing components boiling below 1000° F., said product being characterized by an undesirably high content of sediment—forming components which comprises:

passing said charge hydrocarbon oil containing a substantial quantity of components boiling above about 1000° F. into contact in a conversion zone with (i) a solid heterogeneous catalyst containing a metal of Group IV-B, V-B, VI-B, VII-B, or VIII on a support and (ii) as an oil-miscible catalyst, a molybdenum complex comprising:

2–5 wt % molybdenum;

0.03 wt % alkali metal;

0.1–3 wt % water;

80–96 wt % unreacted diol plus by-product alcohol; and 0.5–10 wt % oxygenates, said oil-miscible catalyst being present in amount sufficient to provide metal in amount of less than about 60 wppm, based on charge hydrocarbon oil;

maintaining said charge hydrocarbon oil containing a substantial quantity of components boiling above about 1000° F. in said conversion zone at conversion conditions in the presence of hydrogen and mercaptan as a substantial portion of said components boiling above about 1000° F. are converted to components boiling below 1000° F. thereby forming product containing a substantial portion of components boiling below about 1000° F. and a content of sediment-forming components which is less than would be formed in the absence of said oil-soluble catalyst; and recovering said product containing a substantial portion of components boiling below about 1000° F.;

wherein said oil-miscible catalyst contains a complex of molybdenum which has been recovered from a reaction mixture wherein it has catalyzed the epoxy-forming reaction of a $C_3$–$C_{20}$ olefin charge stock and an organic peroxide or hydroperoxide.

2. The method of catalytically hydroconverting a charge hydrocarbon oil containing a substantial quantity of components boiling above about 1000° F. in an ebullated bed to convert a substantial portion thereof to product containing components boiling below 1000° F., said product being characterized by an unddesirably high content of sediment—forming components which comprises:

passing said charge hydrocarbon oil containing a substantial quantity of components boiling above about 1000° F. into contact in a conversion zone with (i) a solid heterogeneous catalyst containing a metal of Group IV-B, V-B, VI-B, VII-B, or VIII on a support and (ii) as an oil-miscible catalyst, a molybdenum complex comprising:

2–5 wt % molybdenum;

0.03 wt % alkali metal;

0.1–3 wt % water;

80–96 wt % unreacted diol plus by-product alcohol; and 0.5–10 wt % oxygenates, said oil-miscible catalyst being present in amount sufficient to provide metal in amount of less than about 60 wppm, based on charge hydrocarbon oil;

maintaining said charge hydrocarbon oil containing a substantial quantity of components boiling above about 1000° F. in said conversion zone at conversion conditions in the presence of hydrogen and mercaptan as a substantial portion of said components boiling above about 1000° F. are converted to components boiling below 1000° F. thereby forming product containing a substantial portion of components boiling below about 1000° F. and a content of sediment-forming components which is less than would be formed in the absence of said oil-soluble catalyst; and recovering said product containing a substantial portion of components boiling below about 1000° F.;

wherein said oil-miscible catalyst contains a complex of molybdenum which has been recovered from a reaction mixture wherein it has catalyzed the epoxy-forming reaction of propylene charge stock and a t-butyl hydroperoxide.

* * * * *